US005810462A

United States Patent [19]

Lee

[11] Patent Number: 5,810,462

[45] Date of Patent: Sep. 22, 1998

[54] ROTARY SHELF IN A REFRIGERATOR

[75] Inventor: Sang-Moo Lee, Incheon, Rep. of Korea

[73] Assignee: Daewoo Electronics Co., Ltd., Seoul, Rep. of Korea

[21] Appl. No.: 685,924

[22] Filed: Jul. 22, 1996

[30] Foreign Application Priority Data

Jul. 20, 1995 [KR] Rep. of Korea ..... 95-21435

[51] Int. Cl.[6] ..... E06B 1/00

[52] U.S. Cl. ..... 312/405.1; 312/321.5; 312/274; 312/408; 312/130

[58] Field of Search ..... 312/321.5, 274, 312/271, 275, 405.1, 404, 408, 123, 127, 131, 130, 298, 311, 350, 329, 326; 108/66, 94, 139

[56] References Cited

U.S. PATENT DOCUMENTS

| | | | |
|---|---|---|---|
| 761,552 | 5/1904 | Smith | 312/130 X |
| 1,494,112 | 5/1924 | Hilger | 312/274 X |
| 1,899,171 | 2/1933 | Warren | 312/275 |
| 2,122,680 | 7/1938 | Dart | 312/321.5 X |
| 2,657,110 | 10/1953 | Feder | 312/127 X |
| 2,692,813 | 10/1954 | Toronto | 312/408 |
| 2,839,022 | 4/1958 | Lewis | 312/408 |
| 3,172,715 | 3/1965 | Powder | 312/329 X |
| 4,498,603 | 2/1985 | Wittenborg | 312/97.1 X |
| 5,536,081 | 7/1996 | Pokhis | 312/321.5 |

FOREIGN PATENT DOCUMENTS

| | | | |
|---|---|---|---|
| 1087623 | 8/1960 | Germany | 312/329 |

*Primary Examiner*—Peter M. Cuomo
*Assistant Examiner*—Janet M. Wilkens
*Attorney, Agent, or Firm*—Beveridge, DeGrandi, Weilacher & Young, LLP

[57] ABSTRACT

A rotary shelf in a refrigerator swings together with a door of the refrigerator for being externally drawn out when the door is opened. The rotary shelf is fan-shaped to have a curved portion at one side, and one side of a linear portion is attached to the door to be exposed out of a cooling chamber while swinging in the door direction when the door is opened. A fixed shelf is formed with a guide groove joined with the curved portion for performing a mutual sliding motion in one side thereof, and other sides thereof are fixed to the interior of the cooling chamber, thereby guiding the motion of the rotary shelf.

8 Claims, 3 Drawing Sheets

ROTARY SHELF IN A REFRIGERATOR

BACKGROUND OF THE INVENTION

1. Field of the Invention

The present invention relates to a shelf in a refrigerator, and more particularly to a rotary shelf in a refrigerator capable of being externally-drawn out of a cooling chamber by swinging together with a door of the refrigerator when the door is opened.

2. Description of the Prior Art

A cooling chamber of a conventional refrigerator is constructed in such a manner that a plurality of shelves are traversely installed for accommodating stored items, and slide along guides projecting from sidewalls of the cooling chamber prior to being fixed.

Thus, when a user intends to preserve items such as foods and the like within the cooling chamber, the stored items are sequentially-retained from the inner side of the shelf. If the retaining space is insufficient, the stored items are stacked by several layers.

In the shelf arrangement of the refrigerator, when a stored item accommodated to the inner side of the shelf is to be taken out or when a part of the stored items stacked in layers are taken out, it is inconvenient in that other stored items must be taken out of the refrigerator one by one to be relocated on another place or the position of the stored item desired is difficult to be distinguished. For these reasons, the procedure for accommodating/taking the stored items in/out of the cooling chamber is complicated and troublesome. Furthermore, the door of the cooling chamber is opened for a long time when accommodating or taking out the stored items, thereby increasing power consumption and degrading freshness of the stored items.

U.S. Pat. No. 4,191,437 discloses a rotary shelf in a refrigerator similar to the above-stated one.

SUMMARY OF THE INVENTION

Accordingly, the present invention is devised to solve the foregoing problems. It is an object of the present invention to provide a shelf in a refrigerator, wherein a shelf retaining stored items thereon is drawn out together with a door when a user opens the door for simply and conveniently accommodating and taking out the stored items.

To achieve the above object of the present invention, a shelf in a refrigerator includes the fan-shaped rotary shelf which has a curved portion at one side, and one side of a linear part is attached to a door for swinging in the door direction to be externally drawn out of a cooling chamber when the door is opened, and a fixed shelf which has one side formed with a guide groove joined with the curved portion for performing a mutual sliding motion and an other sides fixed to the interior of the cooling chamber.

Preferably, a roller is installed to the interior of the guide groove at a portion in contact with the rotary shelf.

Here, the rotary shelf may be attached to a pocket of the door, and forms one pair of shelves with the fixed shelf to be installed at the inside of the cooling chamber in plural.

It is preferable that a selection portion is installed between the rotary shelf and door for selectively swinging the shelf when the door is opened, which includes a permanent magnet fixed to the rotary shelf while being sandwiched between the rotary shelf and pocket respectively, an electro-magnet fixed to the pocket for contacting the permanent magnet, and a switch for controlling the magnetization of the electro-magnet.

Also, the switch may be installed to a knob portion of the door, and the number of switches are separately installed in correlation with the installing number of the rotary shelf for controlling respective electro-magnets.

More preferably, a portion for defining a swing range of the rotary shelf is further installed between the rotary shelf and fixed shelf. Here, the defining portion preferably includes a hooking plate installed to one end of the guide groove, and a protrusion part installed at a corner area of the rotary shelf for obstructing swinging movement beyond said hooking plate.

Alternatively, to achieve the above object of the present invention, a shelf in a refrigerator includes the fan-shaped rotary shelf with a curved portion at one side and one side with a linear part being attached to a pocket of a door for swinging in the door direction to be externally drawn out of a cooling chamber when the door is opened, a fixed shelf having one side formed with a guide groove joined with the curved portion for performing a mutual sliding motion and the other sides fixed to the interior of the cooling chamber, in which the rotary shelf and fixed shelf constitute one pair to be installed to the inside of the cooling chamber in plural. In addition, a permanent magnet is fixed to the rotary shelf between the rotary shelf and door while being sandwiched between respective rotary shelf and pocket for selectively swinging the desired shelf when the door is opened, and an electro-magnet is fixed to the pocket for contacting the permanent magnet. Also, a switch for controlling the magnetization of the electro-magnet is separately installed around the knob of the door in a number which correlates with the installing number of the rotary shelves, and a hooking plate installed to one end of the guide groove defines a swing range of the rotary shelf between the rotary shelf and fixed shelf to obstruct the movement of a protrusion part installed to a corner area of the rotary shelf.

In association with the shelf in the refrigerator according to the present invention described as above, the connection switch of the desired rotary shelf is operated with fingers while putting the user's hand into the knob of the refrigerator, thereby opening the door. Then, an electro-magnet of the corresponding rotary shelf is magnetized, so that the electro-magnet and permanent magnet are firmly attached to each other in a body to draw out the rotary shelf together with the door. The door opened as above is stopped by the protrusion part which contacts the hooking plate.

As the result, the rotary shelf in the refrigerator according to the present invention constructed as above can simply and conveniently accommodate or take out the stored items and minimize the time required for opening the door of the cooling chamber. Thus, the power dissipation is remarkably economized and freshness of the stored items is enhanced.

BRIEF DESCRIPTION OF THE DRAWINGS

The above objects and other advantages of the present invention will become more apparent by describing in detail preferred embodiments thereof with reference to the attached drawings in which.

DETAILED DESCRIPTION OF THE PREFERRED EMBODIMENT

Figure 1:
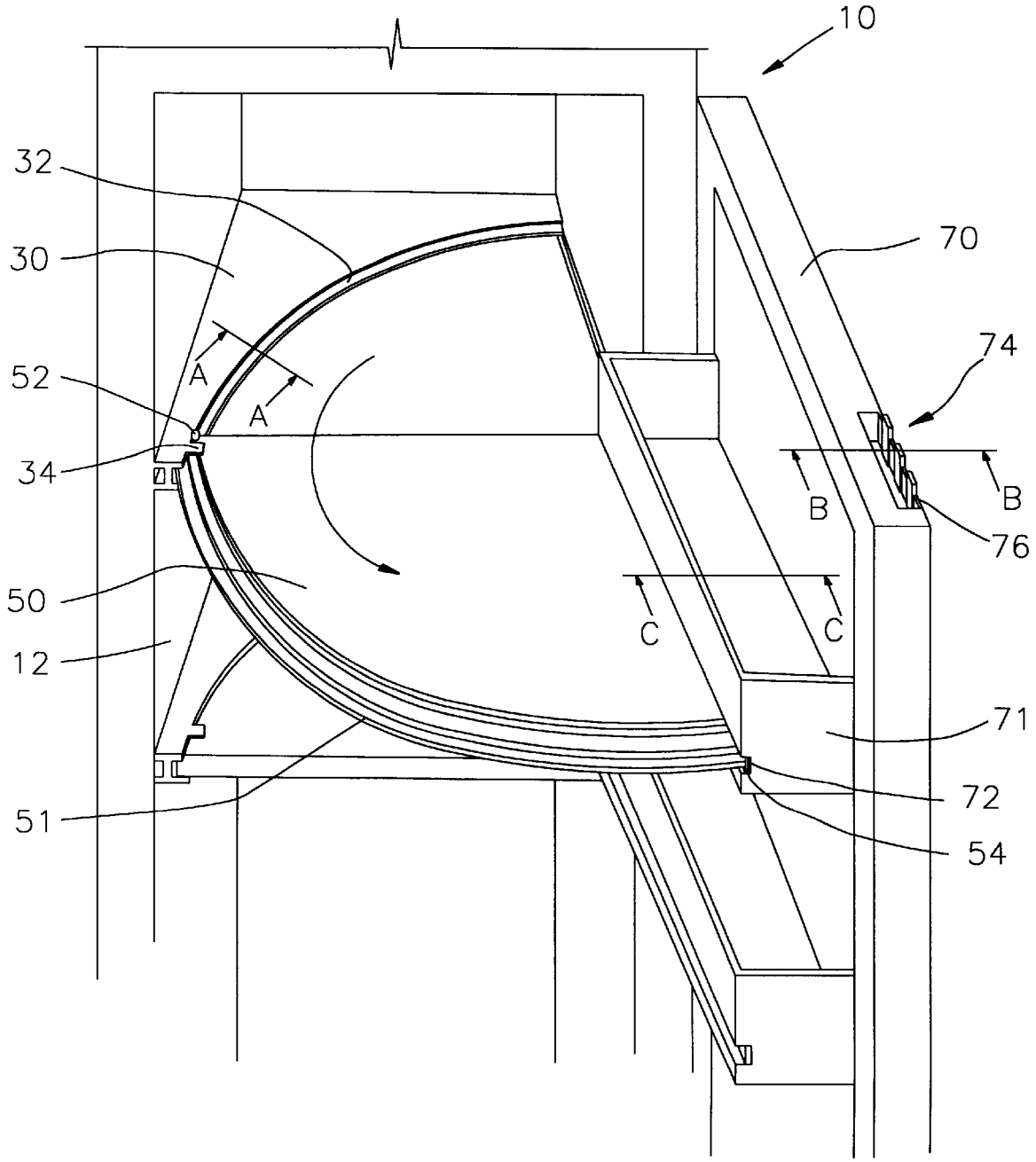
FIG. 1 is a perspective view showing a shelf in a refrigerator according to the present invention drawn out.

A shelf in a refrigerator according to the present invention will be described in detail with reference to FIGS. 1 to 4. FIG. 1 illustrates a section view in which a shelf in a refrigerator 10 according to the present invention is drawn out. Referring to FIG. 1, a refrigerator 10 is largely classified into a rotary shelf 50, a fixed shelf 30, and a door 70.

Rotary shelf 50 has a fan shape like a quadrant to put stored items on the upper plane thereof. A curved part 51 of the rotary shelf 50 forms a circular arc, and a permanent magnet 54 is fitted into one linear part which is connected with the door 70. A protrusion part 52 projects where the other linear part connected to the cooling chamber encounters curved part 51.

A fixed shelf 30 is formed with a guide groove 32 along one side for being inserted with a curved part 51 to allow for the swinging operation, and the other sides are fixed to the sidewalls of a cooling chamber 12. The guide groove 32 is fitted with the curved part 51 of the rotary shelf 50 to be slidable therein. A hooking plate 34 is installed to protrude from fixed shelf 30 to obstruct guide groove 32 when door 70 is opened by as much as approximately 90E at a portion where the rotary shelf 50 contacts the fixed shelf 30.

Switches 74 operated by respective fingers of a user are attached to a knob 76 of the door 70, and a magnetizable electro-magnet 72 is installed to correspond to a permanent magnet 54 of the rotary shelf 50 at an area of the lower end of a door pocket 71 which contains bottles and other small items.

In FIG. 1, a rotary shelf which is not drawn out but joined with a fixed shelf for the user's sake is illustrated at the lower side of the rotary shelf 50.

Figure 2:
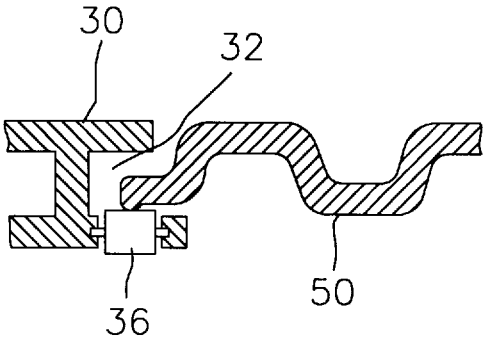
FIG. 2 is an enlarged section view taken along line A—A of FIG. 1.

FIG. 2 is an enlarged section view taken along line A—A of FIG. 1. Here, the curved part 51 of the rotary shelf 50 is fitted into the interior of the guide groove 32 formed into the fixed shelf 30 to be slidable thereon, and a roller 36 is installed at the bottom of the guide groove 32 for reducing friction between the guide groove 32 and the rotary shelf 50.

Figure 3:
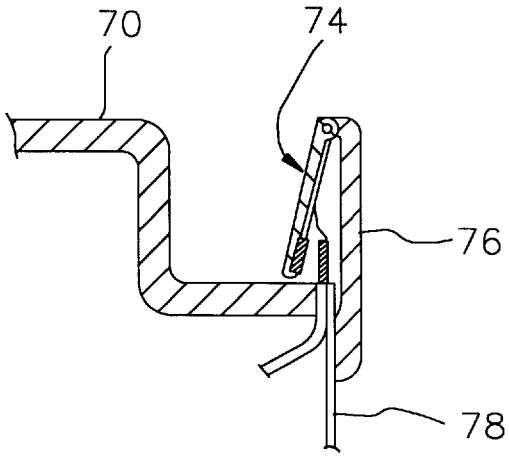
FIG. 3 is an enlarged section view taken along line B—B of FIG. 1.

FIG. 3 illustrates an enlarged section view taken along line B—B of FIG. 1. As shown in FIG. 3, the switch 74 operable by the finger is installed around the knob 76 of the door 70, and an electric wire 78 connected to the switch 74 is further connected to a controlling section (not shown) for magnetizing an electro-magnet 72. The switch 74 is open while a door 70 is closed by using an elastic member such as a spring (not shown), and is then closed when the user presses the knob 76 to open the door 70.

Figure 4:
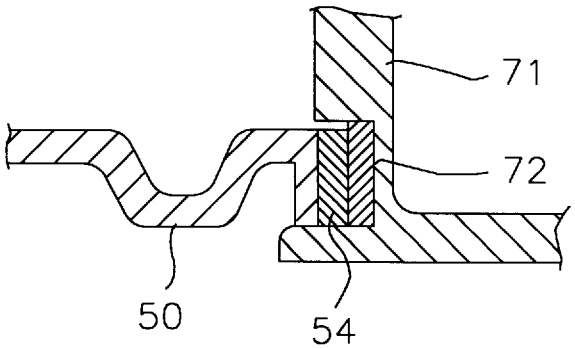
FIG. 4 is an enlarged section view taken along line C—C of FIG. 1.

FIG. 4 is an enlarged section view taken along line C—C of FIG. 1. As shown in FIG. 4, a permanent magnet 54 is assembled to the linear part of the rotary shelf 50, and the electro-magnet 72 is assembled to the lower end of door pocket 71. The permanent magnet 54 and the electro-magnet 72 are attached to each other into one body or separated from each other in accordance with the fact whether electro-magnet 72 is magnetized or not.

In association with the rotary shelf in the refrigerator according to the present invention constructed as above, the following operation is executed when the user intends to open the door 70 of the refrigerator 10.

The user grabs the knob 76 to open the door 70 while operating one among several switches 74 corresponding to the shelf to be drawn out. A signal of the switch 74 operated at this time is transmitted to the controlling section to magnetize an electro-magnet 72 provided at the corresponding shelf. The electro-magnet 72 is magnetized to have a polarity opposite to that of a contacting permanent magnet 54.

The magnetized electro-magnet 72 attracts the permanent magnet 54, so that the electro-magnet 72 and the permanent magnet 54 are firmly attached to each other. Accordingly, when the door 70 is opened, the rotary shelf 50 assembled with the permanent magnet 54 rotate together to be externally drawn out of the cooling chamber 12. The rotary shelf 50 rotating along the guide groove 32 is stopped when the protrusion part 52 contacts the hooking plate 34. By this operation, the stored items put on the rotary shelf 50 are easily taken out of the cooling chamber 12.

The switches 74 which are not selected by the user do not magnetize the electro-magnet 72 nor magnetize it to have the polarity identical to that of the permanent magnet 54. In this case, no force is exerted nor a reaction force is exerted between the permanent magnet 54 and electro-magnet 72. For this reason, the rotary shelf 50 does not swing with the door 70 but remains within the cooling chamber 12 despite the door 70 being opened. In other words, the user can draw out only the required shelf among the swing shelves stacked in layers, since the other shelves remain within the cooling chamber 12 intact.

If the door 70 is closed after the rotary shelf 50 has been taken out, the door 70 is simply pushed and closed which accommodates the rotary shelf 50 into the interior of cooling chamber 12.

As a result, in view of the shelf in the refrigerator according to the present invention constructed as above, the shelf retaining the stored item required by the user is easily selected to be drawn out. Also, the required shelf is externally drawn out simply by opening the door without performing another draw-out operation, and the shelf can be easily accommodated to minimize the time of opening the door. By doing so, the power dissipation of the refrigerator is economized, and freshness of the stored items is maintained for a long time period.

While the present invention has been particularly shown and described with reference to particular embodiment thereof, it will be understood by those skilled in the art that various changes in form and details may be effected therein without departing from the spirit and scope of the invention as defined by the appended claims.

What is claimed is:

1. A shelf in a refrigerator comprising:

a fan-shaped rotary shelf having a curved portion at one side, and one side of a linear part being attached to a door for swinging in the door direction to be externally drawn out of a cooling chamber when said door is opened;

a fixed shelf having one side formed with a guide groove joined with said curved portion for performing a mutual sliding motion and other sides fixed to the interior of said refrigerator;

wherein, said rotary shelf and said fixed shelf forming one pair of shelves are installed at the inside of said refrigerator in plural; and selection means between said rotary shelf and said door for selectively swinging the rotary shelf when said door is opened.

2. The shelf in a refrigerator as claimed in claim 1, further comprising a roller at the interior of said guide groove for decreasing friction at a portion in contact with said rotary shelf.

3. The shelf in a refrigerator as claimed in claim 1, wherein said rotary shelf is attached to a pocket of said door.

4. The shelf in a refrigerator as claimed in claim 3, wherein said selecting means comprises:

a permanent magnet fixed to said rotary shelf while being sandwiched between said rotary shelf and said pocket respectively;

an electro-magnet fixed to said pocket for contacting said permanent magnet; and a switch for controlling the magnetization of said electro-magnet.

5. The shelf in a refrigerator as claimed in claim 4, wherein said switch is installed to a knob portion of said door.

6. The shelf in a refrigerator as claimed in claim 5, wherein said switch is separately installed in a number corresponding to the installing number of said rotary shelf for controlling respective electro-magnets.

7. The shelf in a refrigerator as claimed in claim 1, further comprising means for defining a swinging range of said rotary shelf between said rotary shelf and said fixed shelf, wherein said defining means comprises:

a hooking plate installed to one end of said guide groove; and a protrusion part installed to a corner area of said rotary shelf for obstructing swinging movement beyond said hooking plate.

8. The shelf in a refrigerator comprising:

a fan-shaped rotary shelf having a curved portion at one side, and one side of a linear part being attached to a pocket of a door for swinging in the door direction to be externally drawn out of a cooling chamber when said door is opened;

a fixed shelf having one side formed with a guide groove joined with said curved portion for performing a mutual sliding motion, installed with a roller at the interior of said guide groove at a portion in contact with said rotary shelf, and having other sides fixed to the interior of said refrigerator, said rotary shelf and said fixed shelf forming one pair of shelves installed at the inside of said refrigerator in plural;

a permanent magnet fixed to said rotary shelf between said rotary shelf and said door while being sandwiched between said rotary shelf and said pocket respectively for selectively swinging the rotary shelf when said door is opened;

an electro-magnet fixed to said pocket for contacting said permanent magnet;

a switch for controlling the magnetization of said electro-magnet separately installed around a knob of said door in a number corresponding to the installing number of said rotary shelf to control respective electro-magnets;

a hooking plate installed to one end of said guide groove for defining a swing range of said rotary shelf between said rotary shelf and fixed shelf; and a protrusion part installed to a corner area of said rotary shelf for obstructing swinging movement beyond said hooking plate.

* * * * *